US011359641B1

(12) United States Patent
Tzeng

(10) Patent No.: US 11,359,641 B1
(45) Date of Patent: Jun. 14, 2022

(54) AIR MOVING DEVICE WITH BLADE TIP OF VARIABLE CURVATURE

(71) Applicant: Stokes Technology Development Ltd., Taoyuan (TW)

(72) Inventor: Yih-Wei Tzeng, Taoyuan (TW)

(73) Assignee: STOKES TECHNOLOGY DEVELOPMENT LTD., Taoyuan (TW)

( * ) Notice: Subject to any disclaimer, the term of this patent is extended or adjusted under 35 U.S.C. 154(b) by 0 days.

(21) Appl. No.: 17/501,871

(22) Filed: Oct. 14, 2021

(51) Int. Cl.
*F04D 29/38* (2006.01)
*F04D 19/00* (2006.01)

(52) U.S. Cl.
CPC ..... *F04D 29/384* (2013.01); *F04D 19/002* (2013.01)

(58) Field of Classification Search
CPC ..... F04D 29/384; F04D 19/002
See application file for complete search history.

(56) References Cited

U.S. PATENT DOCUMENTS 5,616,004 A * 4/1997 Alizadeh ..... F04D 29/384 415/119
2004/0136830 A1* 7/2004 Eguchi ..... F04D 29/667 416/228
2013/0202443 A1* 8/2013 Tzeng ..... F01D 5/34 416/223 R
2016/0061217 A1* 3/2016 Duong ..... F04D 19/00 416/243
2016/0273547 A1* 9/2016 Gallagher ..... F04D 29/384
2017/0122336 A1* 5/2017 Billings ..... F04D 29/384
2017/0159670 A1* 6/2017 Gallagher ..... F01D 5/141

* cited by examiner

*Primary Examiner* — Aaron R Eastman
(74) *Attorney, Agent, or Firm* — Chun-Ming Shih; HDLS IPR Services

(57) ABSTRACT

This disclosure provides an air moving device with blade tip of variable curvature. The axial air moving device includes a hub and a plurality of blades. The blades are connected with the hub, and each blade is configured by stacking multiple wing sections continuously. Each blade includes a blade root and a blade tip. The span position of the blade at the blade root is defined as 0, and at the blade tip is defined as 1. The blade angle is defined by the nose-tail line of the wing section and the rotation direction of the axial air moving device. The blade angle of the wing section at the blade tip of the blade is at least 10 degrees less than the blade angle of the wing section at the span position of 0.8 of the blade.

6 Claims, 10 Drawing Sheets

AIR MOVING DEVICE WITH BLADE TIP OF VARIABLE CURVATURE

BACKGROUND

Technical Field

The technical field relates to an axial air moving device, and more particularly relates to an axial air moving device with blade tip of variable curvature.

Description of Related Art

A cooling axial air moving device is composed of a motor, a hub, and a plurality of blades arranged around the hub. The motor drives the hub to rotate to let the blades induce the fluid flowing. The axis of the motor rotation is parallel to the air moving direction.

Moreover, the operation efficiency of the cooling air moving device is closely related to the structure, shape design, and other parameters of the blades. The blades of cooling air moving devices of the related art are configured by wing sections at different radius position, and the distribution of the blade angle of each wing section is disposed smoothly. Additionally, the operation of the cooling air moving device generates not only high air flowrate, but also sufficient air pressure to effectively overcome the flow resistance of the environment.

Due to the emphasis on energy efficiency in recent years, in the design of cooling air moving devices, in addition to improving the performance of air pressure and air flowrate, how to improve the operation efficiency has gradually become an important topic. Accordingly, how to design the blade structure of the cooling air moving device to improve the operation efficiency of the blade and achieve energy saving is the motivation of this invention.

SUMMARY

One object of this disclosure is to provide an axial air moving device with blade tip of variable curvature, the shape of the blade tip of the blade has advantages of improving the efficiency of operation.

In order to achieve the object mentioned above, this disclosure provides an axial air moving device with blade tip of variable curvature. The axial air moving device includes a hub and a plurality of blades. The blades are connected with the hub and arranged spacedly on the periphery of the hub, and each of the blades is configured by stacking multiple wing sections continuously. Each blade includes a blade root connected to the hub and a blade tip located away from the hub. A span position of the blade at the blade root is defined as 0, and at the blade tip is defined as 1. A blade angle is defined by a nose-tail line of the wing section and a rotation direction of the axial air moving device. The blade angle of the wing section at the blade tip is at least 10 degrees less than the blade angle of the wing section at the span position of 0.8 of the blade.

In this disclosure, the blade of this disclosure has a large variation of curvature between the span position of 0.8 and the span position of 1. The blade angle at the blade tip is at least 10 degrees less than the blade angle at the span position of 0.8, so as to reduce the energy loss of the tip vortex and the torque formed by the tangential component of the force at the blade tip. The axial air moving device with blade tip of variable curvature of this disclosure requires less operation energy to achieve a given operation point compared to the previous art, or when the axial air moving device of this disclosure is operated under the given power, it provides a better performance curve. On the other word, the operation efficiency of the axial air moving device in this disclosure is improved, and the practicability of this disclosure is enhanced.

BRIEF DESCRIPTION OF DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

Figure 1:
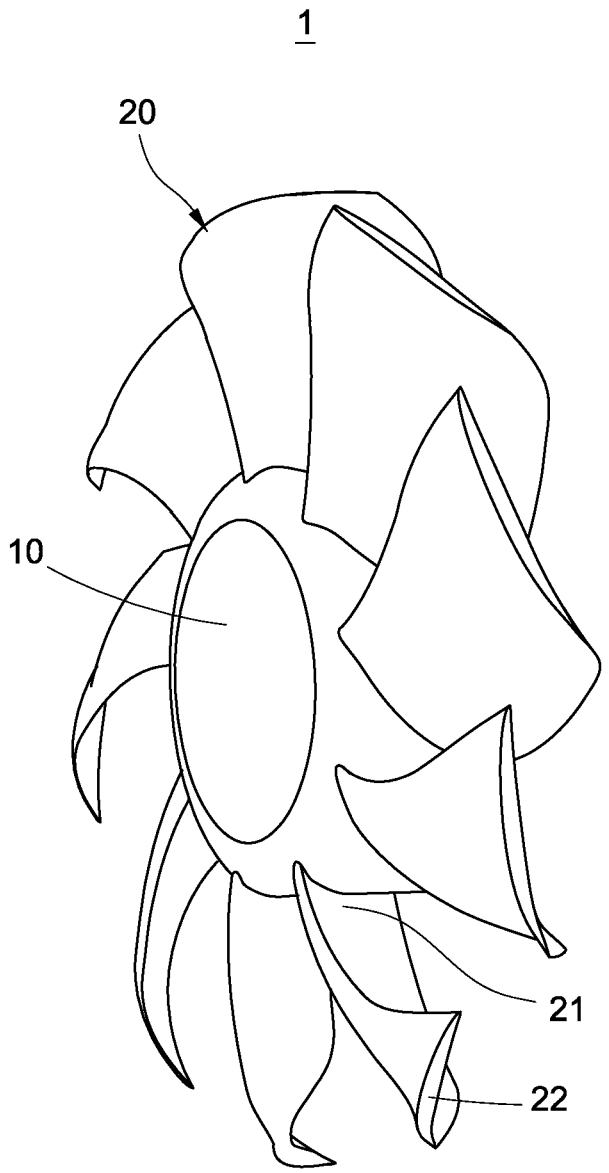
FIG. 1 is a perspective schematic view of the axial air moving device with blade tip of variable curvature in this disclosure.
Figure 2:
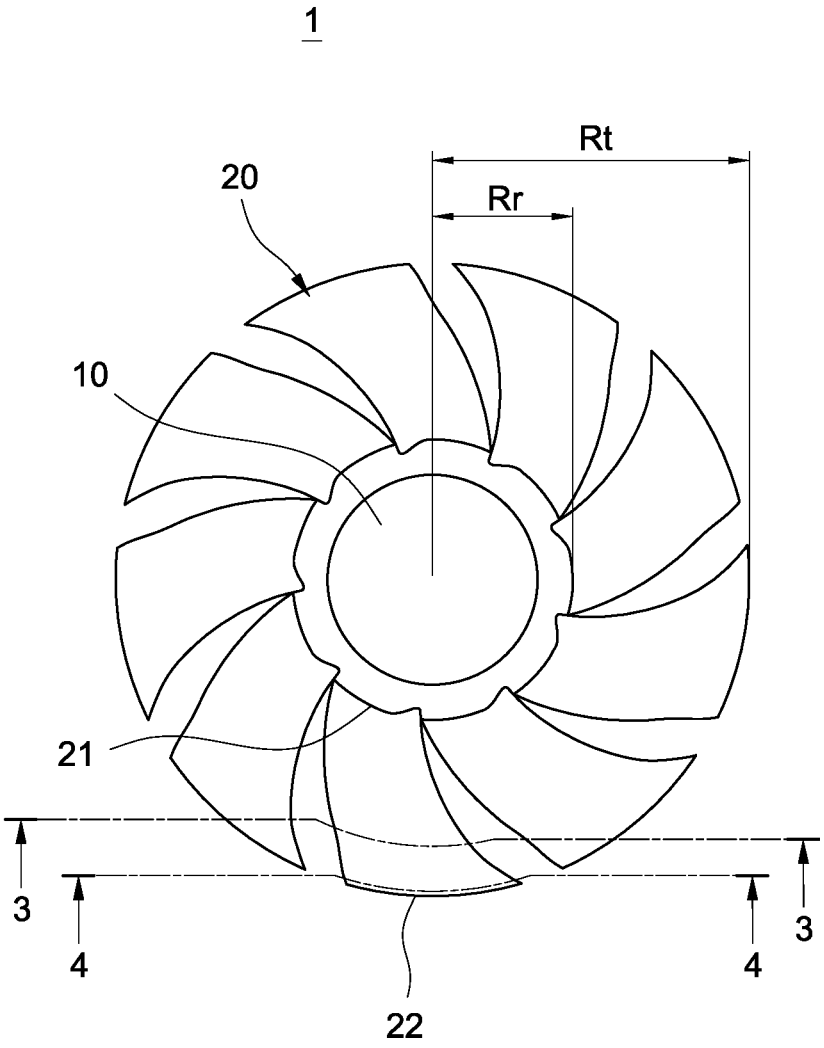
FIG. 2 is a planar schematic view of the axial air moving device with blade tip of variable curvature in this disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIG. 1 to FIG. 4, which respectively depict a perspective schematic view of the axial air moving device with blade tip of variable curvature in this disclosure, a planar schematic view of the axial air moving device with blade tip of variable curvature in this disclosure, a schematic view of the blade angle at the span position of about 0.8 of the blade in this disclosure, and a schematic view of the blade angle at the span position of about 1 of the blade in this disclosure. The axial air moving device with blade tip of variable curvature of this disclosure includes a hub 10 and a plurality of blades 20. The blades 20 are connected with the hub 10 and arranged spacedly on a periphery of the hub 10 annularly. Additionally, each of the blade 20 includes a blade root 21 connected to the hub 10 and a blade tip 22 located away from the hub 10.

It should be noted that the span position is defined as the radius position (r) minus the radius of the blade root (Rr) and then divided by the radius of the blade tip (Rt) minus the radius of the blade root (Rr). The formula is as follows. Accordingly, the span position at the blade root connected to the hub is defined as 0, and the span position at the blade tip is defined as 1.

$$\text{Span position} = \frac{(\text{radius position } (r) - \text{radius of the blade root } (Rr))}{(\text{radius of the blade tip } (Rt) - \text{radius of the blade root } (Rr))}$$

In this embodiment, the span position at the blade root 21 of the blade 20 is defined as 0, and the span position at the blade tip 22 of the blade 20 is defined as 1.

Moreover, each of the blades 20 is configured by stacking multiple wing sections continuously. Additionally, the blade angle is defined (formed) by the nose-tail line of the wing section and the rotation direction U of the axial air moving device.

Figure 3:
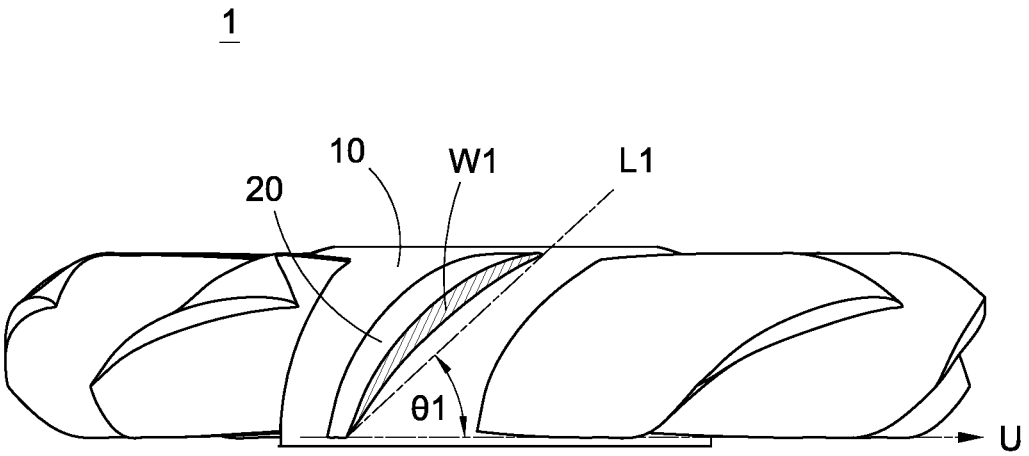
FIG. 3 is a schematic view of the blade angle at the span position of about 0.8 of the blade in this disclosure.
Figure 4:
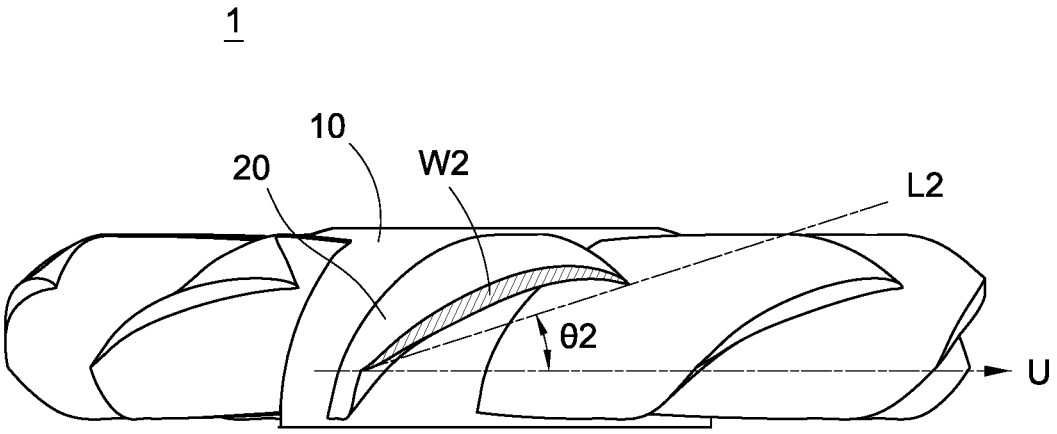
FIG. 4 is a schematic view of the blade angle at the span position of 1 of the blade in this disclosure.

As shown in FIG. 3 and FIG. 4, which respectively depict the blade angle at the span position of about 0.8 and the span position of about 1 (at the blade tip 22) of the wing section of the blade 20. In FIG. 3, the angle θ1 is formed by the nose-tail line L1 of the wing section W1 at the span position of about 0.8 and the rotation direction U (the blade angle at the span position of about 0.8 is θ1). In this embodiment, the blade angle θ1 is about 43 degrees. Furthermore, in FIG. 4, the angle θ2 is formed by the nose-tail line L2 of the wing section W2 at the span position of about 1 and the rotation direction U (the blade angle at the span position of about 1 is θ2). In this embodiment, the blade angle θ2 is about 18 degrees. Therefore, the difference between the blade angle θ2 at the blade tip 22 and the blade angle θ1 at the span position of about 0.8 is about 25 degrees.

Figure 5:
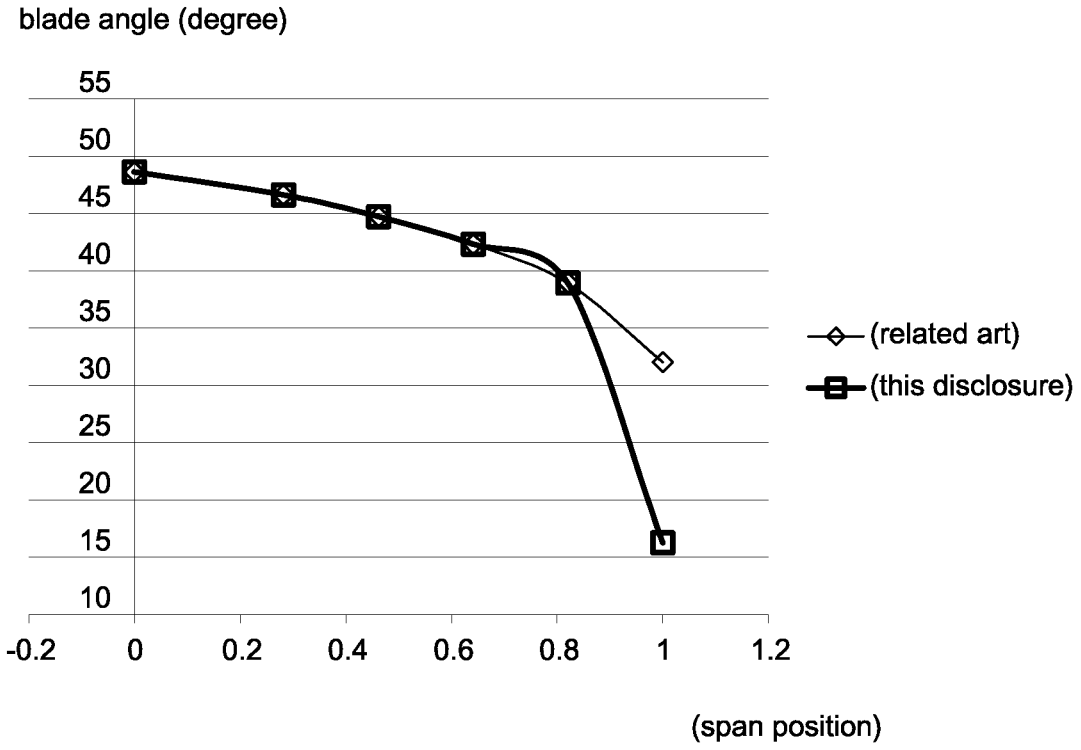
FIG. 5 is a comparison diagram of the curve of the blade angle at different span positions of the axial air moving device in this disclosure and the related art.

Please further refer to FIG. 5, it depicts a comparison diagram of the curve of the blade angle at different span positions of the axial air moving device in this disclosure and the related art. As shown in the figure, the curve of the blade angle at the different span positions has a greater variation at the end region comparing to the related art. That is, the blade angle of the blade 20 of this disclosure has a relatively large variation between the span position of about 0.8 and the span position of about 1. Thus, the shape and the structure of the blade may have a greater variation of curvature in this interval.

Specifically, the blade angle θ 2 of the wing section W2 at the blade tip 22 of the blade 20 is at least 10 degrees less than the blade angle θ1 of the wing section W1 at the span position of about 0.8 of the blade 20. In some embodiments, the blade angle θ2 of the wing section W2 at the blade tip 22 is greater than 5 degrees.

Figure 6:
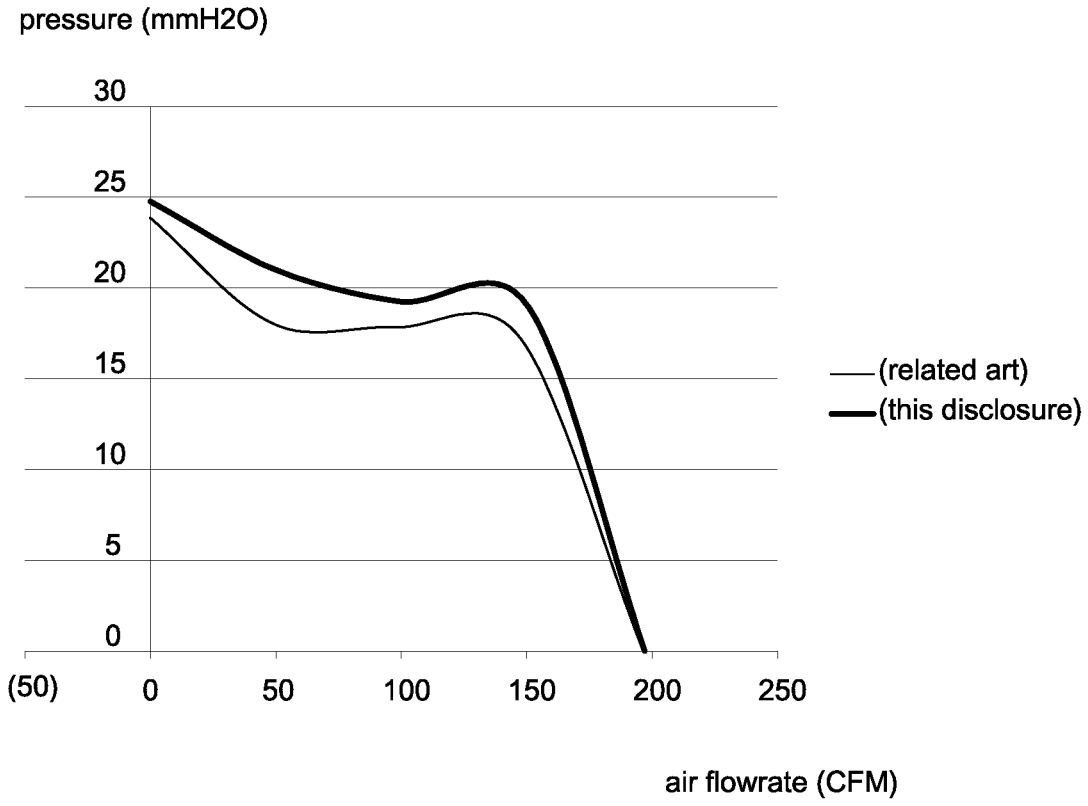
FIG. 6 is a comparison diagram of the curve of the static pressure versus air flowrate of the axial air moving device in this disclosure and the related art under the same power consumption and device dimensions.
Figure 7:
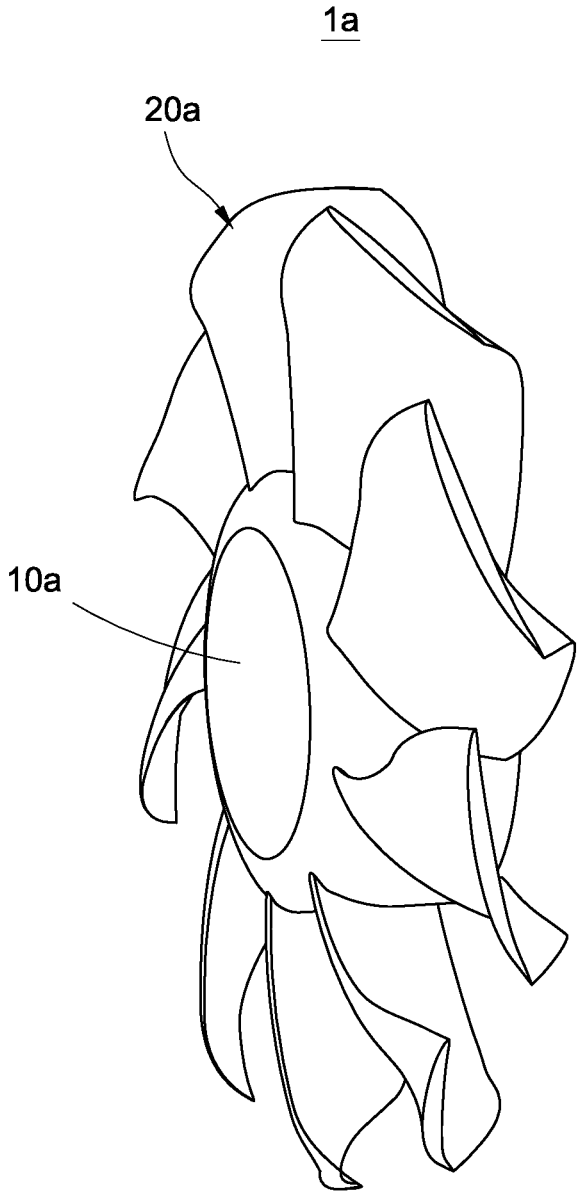
FIG. 7 is a perspective schematic view of another embodiment of the axial air moving device with blade tip of variable curvature in this disclosure.
Figure 8:
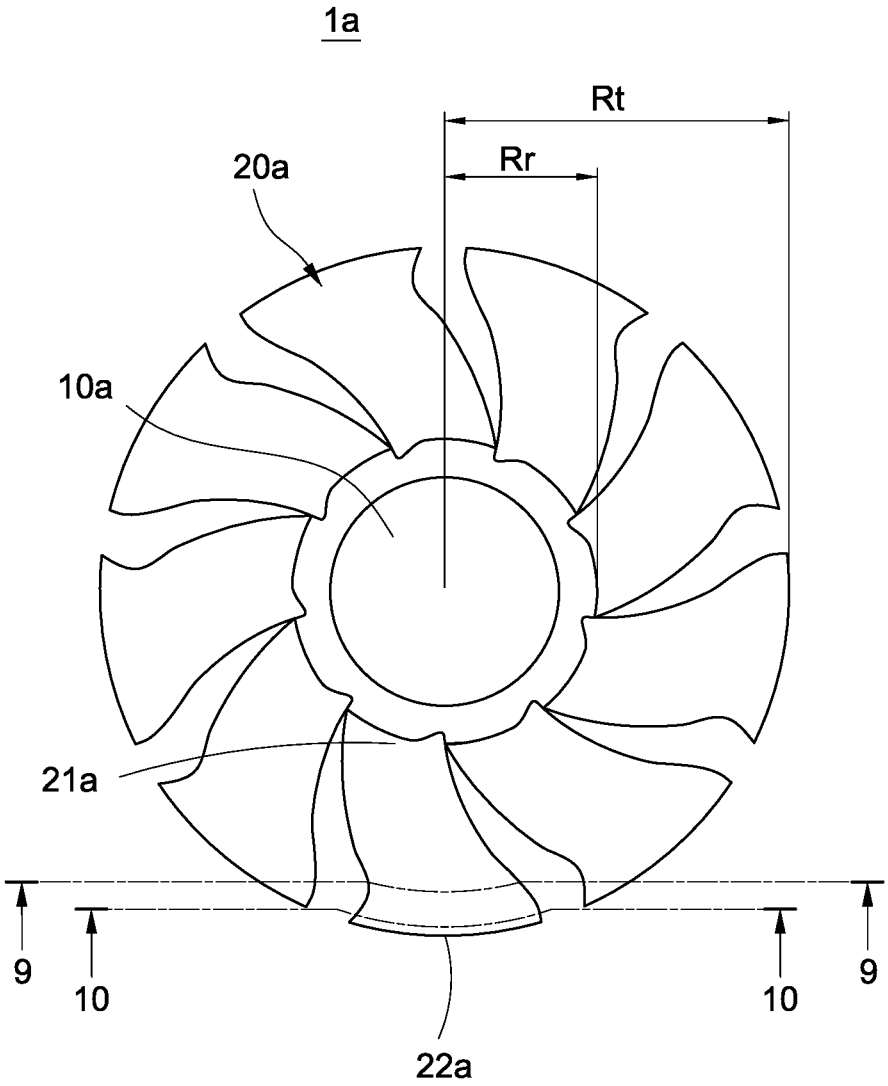
FIG. 8 is a planar schematic view of another embodiment of the axial air moving device with blade tip of variable curvature in this disclosure.

Please further refer to FIG. 6, which depicts a comparison diagram of the curves of the static pressure versus air flowrate of the axial air moving device in this disclosure and the related art under the same power consumption and device dimensions. As shown in the figure, under the same air flowrate, the characteristic curve of the axial air moving device with blade tip of variable curvature of this disclosure (represented in the thick line) has a higher air pressure than the cooling axial air moving device of the related art (represented in the thin line). In other words, the characteristic curve of the axial air moving device with blade tip of variable curvature of this disclosure has a higher air flowrate under the same air pressure. Accordingly, the axial air moving device with blade tip of variable curvature of this disclosure provides a better performance comparing with the cooling axial air moving device of the related art, and the efficiency of operation of the axial air moving device of this disclosure is improved. Therefore, in contrast to the related art, the axial air moving device of this disclosure provides the same performance but requires less power consumption, and that is an improvement for energy saving.

It should be noted the blade angle of the blade 20 of this disclosure has a larger variation between the span position of about 0.8 and the span position of about 1, so as to reduce the energy loss of the tip vortex at the blade tip and the torque formed by the tangential component of the force at the blade tip.

Please refer to FIG. 7 to FIG. 10, which respectively depict a perspective schematic view of another embodiment of the axial air moving device with blade tip of variable curvature in this disclosure, a planar schematic view of another embodiment of the axial air moving device with blade tip of variable curvature in this disclosure, a schematic view of the blade angle at the span position of about 0.8 of the blade of another embodiment in this disclosure, and a schematic view of the blade angle at the span position of about 1 of the blade of another embodiment in this disclosure. This embodiment is similar to the previous embodiment, the axial air moving device 1*a* with blade tip of variable curvature includes a hub 10*a* and a plurality of blades 20*a*. Each of the blades 20*a* includes a blade root 21*a* connected to the hub 10*a* and a blade tip 22*a* located away from the hub 10*a*.

Figure 9:
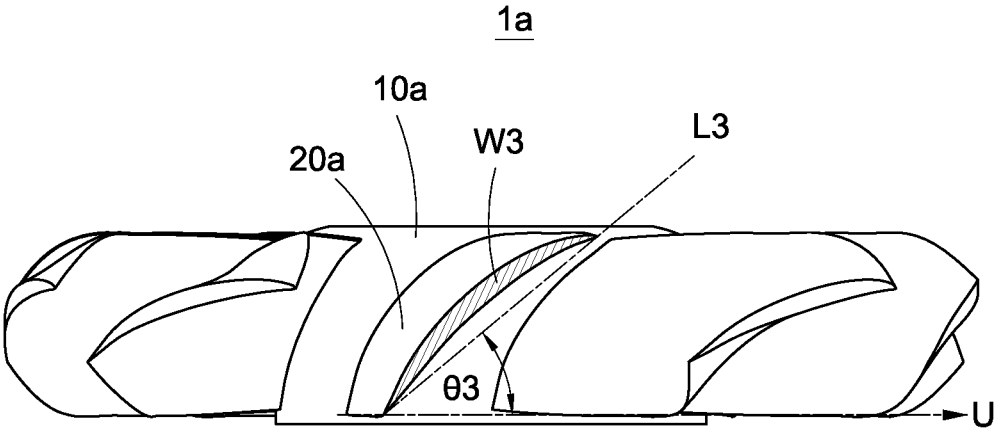
FIG. 9 is a schematic view of the blade angle at the span position of about 0.8 of the blade of another embodiment in this disclosure.
Figure 10:
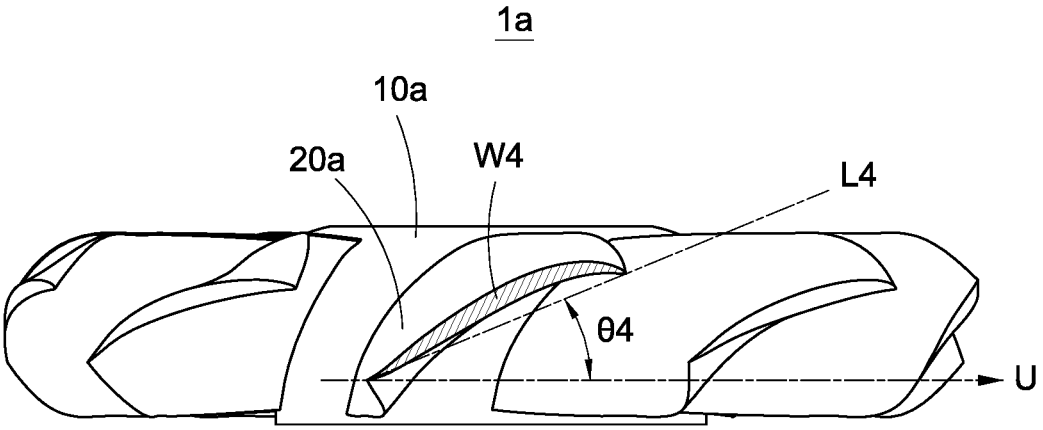
FIG. 10 is a schematic view of the blade angle at the span position of about 1 of the blade of another embodiment in this disclosure.

FIG. 9 shows the schematic view of the blade angle, where an angle θ3 is formed by the nose-tail line L3 of the wing section W3 at the span position of about 0.8 of the blade 20*a* and the rotation direction U (the blade angle at the span position of about 0.8 is θ3). In this embodiment, the blade angle θ3 is about 40 degrees. Additionally, the FIG. 10 shows the angle θ4 formed by the nose-tail line L4 of the wing section W4 at the span position of about 1 of the blade 20*a* and the rotation direction U (the blade angle at the span position of about 1 is θ4). In this embodiment, the blade angle θ4 is about 22 degrees. Therefore, the difference between the blade angle θ4 on the position at the blade tip 22*a* and the blade angle θ3 on the span position of about 0.8 is about 18 degrees.

Figure 11:
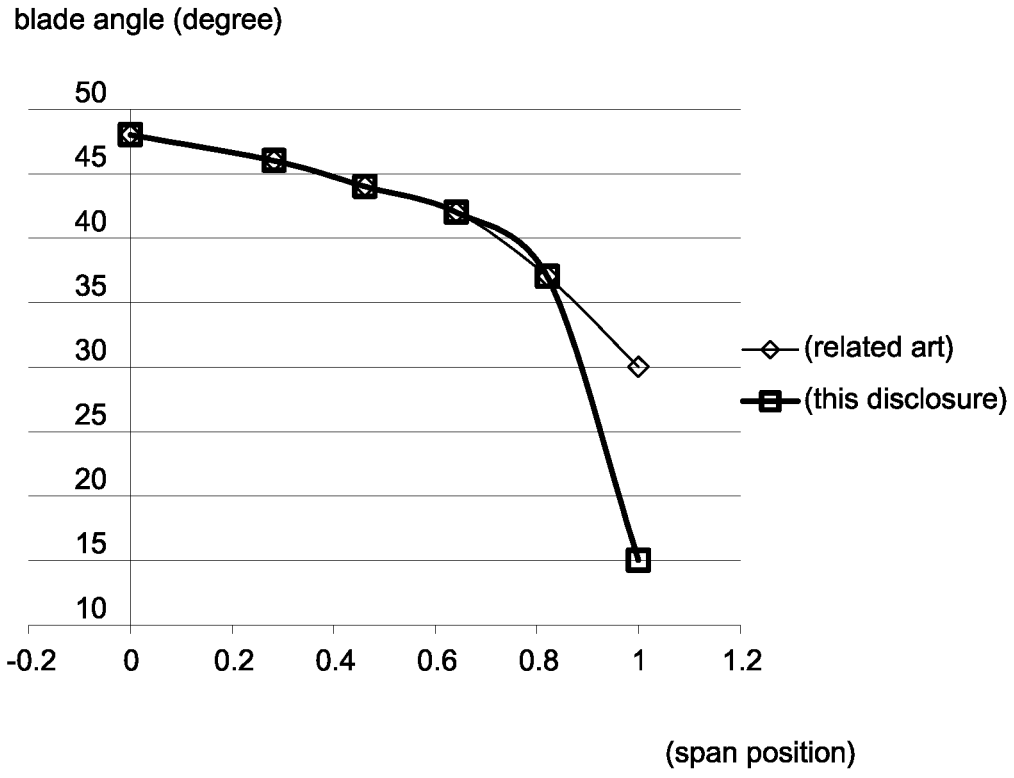
FIG. 11 is a comparison diagram of the curve of blade angle at different span positions of the axial air moving device of another embodiment in this disclosure and the related art.

As shown in FIG. 11, it depicts a comparison diagram of the curve of blade angle at different span positions of the axial air moving device of another embodiment in this disclosure and the related art. In this embodiment, the curve of the blade angle at the span positions has a greater variation at the end region (a greater variation of the blade angle) comparing with the blade of the related art. Therefore, the shape and structure of the blade has a greater variation of curvature in this interval.

Figure 12:
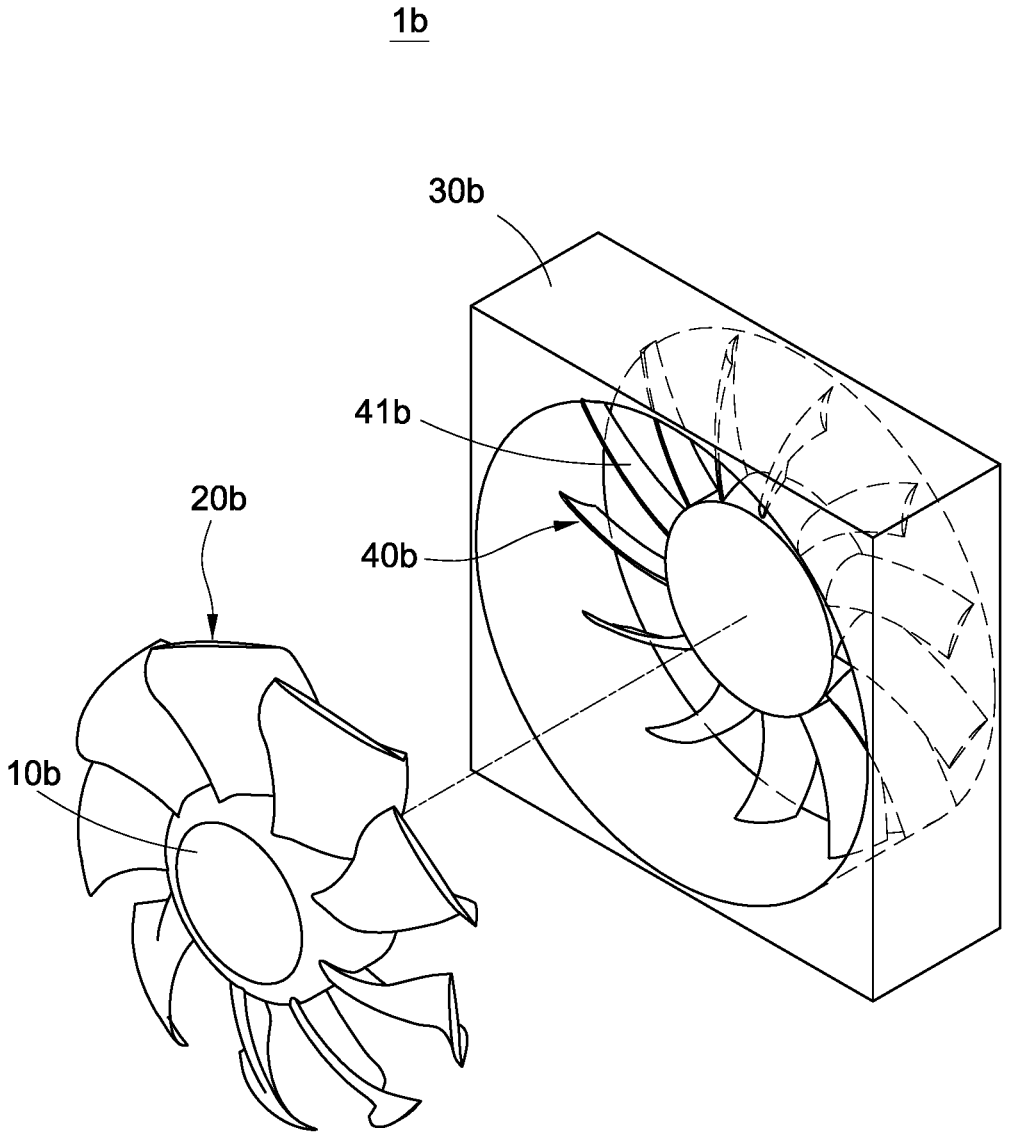
FIG. 12 is a perspective exploded schematic view of the axial air moving device with blade tip of variable curvature of a still another embodiment in this disclosure.

Please further refer to FIG. 12, it depicts a perspective exploded schematic view of the axial air moving device with blade tip of variable curvature of a still another embodiment in this disclosure. This embodiment is similar to the previous embodiment, and the difference is that the axial air moving device 1*b* with blade tip of variable curvature of this embodiment includes not only a hub 10*b* and a plurality of an axial air moving device blades 20*b*, but also a housing 30*b* and a stator structure 40*b*. This embodiment shows that the application of the axial air moving device of this disclosure is not limited to a single rotor air moving device, but may also be applied to a rotor-stator axial air moving device. In addition, in some embodiments, the blade of this disclosure may be applied to an axial air moving device with series rotors.

Specifically, the hub 10*b* and the blades 20*b* are disposed in the housing 30*b*. Moreover, the stator structure 40*b* is fixed in the housing 30*b* corresponding to the blades 20*b*. The arrangement of the stator structure 40*b* may be used to recover the rotational kinetic energy in the airflow for increasing the static pressure or the axial flow of the axial air moving device. In this embodiment, the stator structure 40*b* includes a plurality of stator blades 41*b* arranged spacedly and annularly on the housing 30*b*.

While this disclosure has been described by means of specific embodiments, numerous modifications and variations could be made thereto by those skilled in the art without departing from the scope and spirit of this disclosure set forth in the claims.

What is claimed is:

1. An axial air moving device, comprising:

a hub; and a plurality of blades, connected with the hub and arranged spacedly on a periphery of the hub, and each of the blades configured by stacking multiple wing sections continuously, and each of the blades comprising a blade root connected to the hub and a blade tip located away from the hub;

wherein a span position of the blade at the blade root is defined as 0, and at the blade tip is defined as 1;

a blade angle is defined by a nose-tail line of the wing section and a rotation direction of the axial air moving device;

the blade angle of the wing section at the blade tip is at least 10 degrees less than the blade angle of the wing section at the span position of 0.8 of the blade; and wherein a slope value of a curve of a blade angle distribution along the span between 0.8 span and 1.0 span is significantly larger than a slope value of the curve of the blade angle distribution along the span between 0 span and 0.8 span.

2. The axial air moving device according to claim 1, wherein the blade angle of the wing section at the blade tip is greater than 5 degrees.

3. The axial air moving device according to claim 1, further comprising a housing, wherein the hub and the blades are disposed in the housing.

4. The axial air moving device according to claim 3, further comprising a stator structure, wherein the stator structure is fixed in the housing corresponding to the blades.

5. The axial air moving device according to claim 4, wherein the stator structure comprises a plurality of stator blades arranged spacedly and annularly on the housing.

6. The axial air moving device according to claim 1, wherein the blade angle of the wing section decreases less than 20 degrees from the blade root to the span position of 0.8 of the blade.

* * * * *